US006406611B1

(12) United States Patent
Engelhaupt et al.

(10) Patent No.: US 6,406,611 B1
(45) Date of Patent: Jun. 18, 2002

(54) NICKEL COBALT PHOSPHOROUS LOW STRESS ELECTROPLATING

(75) Inventors: Darell E. Engelhaupt, Madison; Brian D. Ramsey, Huntsville, both of AL (US)

(73) Assignees: University of Alabama in Huntsville, Huntsville, AL (US); The United States of America as represented by the Marshall Space Flight Center, Washington, DC (US)

( * ) Notice: Subject to any disclaimer, the term of this patent is extended or adjusted under 35 U.S.C. 154(b) by 0 days.

(21) Appl. No.: 09/456,862

(22) Filed: Dec. 8, 1999

(51) Int. Cl.[7] ..... C25D 3/56

(52) U.S. Cl. ..... 205/259; 205/255; 205/236; 205/258; 106/1.27

(58) Field of Search ..... 106/1.27; 205/236, 205/255, 258, 271–280, 259

(56) References Cited

U.S. PATENT DOCUMENTS

| | | | | |
|---|---|---|---|---|
| 2,644,787 A | | 7/1953 | Bonn et al. | |
| 3,637,471 A | * | 1/1972 | Faulkner | 204/43 |
| 4,101,389 A | | 7/1978 | Uedaira | |
| 4,529,668 A | | 7/1985 | Croopnick et al. | |
| 4,619,872 A | | 10/1986 | Goor et al. | |
| 4,647,365 A | | 3/1987 | Irlesberger et al. | |
| 4,648,944 A | | 3/1987 | George et al. | |
| 4,673,468 A | | 6/1987 | Myers et al. | |
| 4,767,509 A | | 8/1988 | Gamblin et al. | |
| 4,770,751 A | | 9/1988 | Kawagishi et al. | |
| 4,786,376 A | | 11/1988 | Vaaler | |
| 4,808,967 A | | 2/1989 | Rice et al. | |
| 4,888,574 A | | 12/1989 | Rice et al. | |
| 4,892,628 A | * | 1/1990 | Guilinger | 204/44.7 |
| 4,935,310 A | | 6/1990 | Nakatsugawa | |
| 4,986,130 A | | 1/1991 | Engelhaupt et al. | |
| 5,032,464 A | | 7/1991 | Lichtenberger | |
| 5,302,464 A | | 4/1994 | Nomura | |
| 5,389,226 A | | 2/1995 | Scruggs et al. | |
| 5,779,873 A | * | 7/1998 | Law et al. | 205/271 |
| 5,901,432 A | | 5/1999 | Armstrong et al. | |
| 6,099,624 A | * | 8/2000 | Martyak | 106/1.27 |

FOREIGN PATENT DOCUMENTS

EP 0 502 475 A2 9/1992

OTHER PUBLICATIONS

Electroformed Bulk Nickel–Phosphorous Metallic Glass, A Mayer et al., Plating and Surface Finishing, pp. 76–78, No. 1985.

Evaluation of Electroplated Nickel Phosphorous With High Phosphorous Content, Hans van Oosterhout; AMP Journal of Technology, vol. 2, Nov. 1992, pp. 63–69.

Structure & Properties of Electroless Ni–P–$B_4C$ Composite Coatings, J–P Ge et al., Plating & Surface Finishing, Oct. 1998, pp. 69, 70, and 73.

High–Temperature High–Strength Nickel Base Alloys, NiDI (Nickel Development Institute), 1995 Supplement No. 393, No Month Available.

Electrodeposition of Ni–Cr–P Alloys In the Presence of Additives, R., Bindish et al., Plating and Surface Finishing, pp. 68–73, Apr. 1992.

Electrodeposition of Alloys Containing Phosphorus and Nickel or Cobalt, pp. 457–483, No Date Available.

* cited by examiner

*Primary Examiner*—Robert Dawson
*Assistant Examiner*—Michael J Feely
(74) *Attorney, Agent, or Firm*—Alston & Bird LLP

(57) ABSTRACT

An electrolytic plating process is provided for electrodepositing a nickel or nickel cobalt alloy which contains at least about 2% to 25% by atomic volume of phosphorous. The process solutions contains nickel and optionally cobalt sulfate, hypophosphorous acid or a salt thereof, boric acid or a salt thereof, a monodentate organic acid or a salt thereof, and a multidentate organic acid or a salt thereof. The pH of the plating bath is from about 3.0 to about 4.5. An electroplating process is also provided which includes electroplating from the bath a nickel or nickel cobalt phosphorous alloy. This process can achieve a deposit with high microyield of at least about 84 kg/mm$^2$ (120 ksi) and a density lower than pure nickel of about 8.0 gm/cc. This process can be used to plate a deposit of essentially zero stress at plating temperatures from ambient to 70° C.

36 Claims, 3 Drawing Sheets

Figure 2:
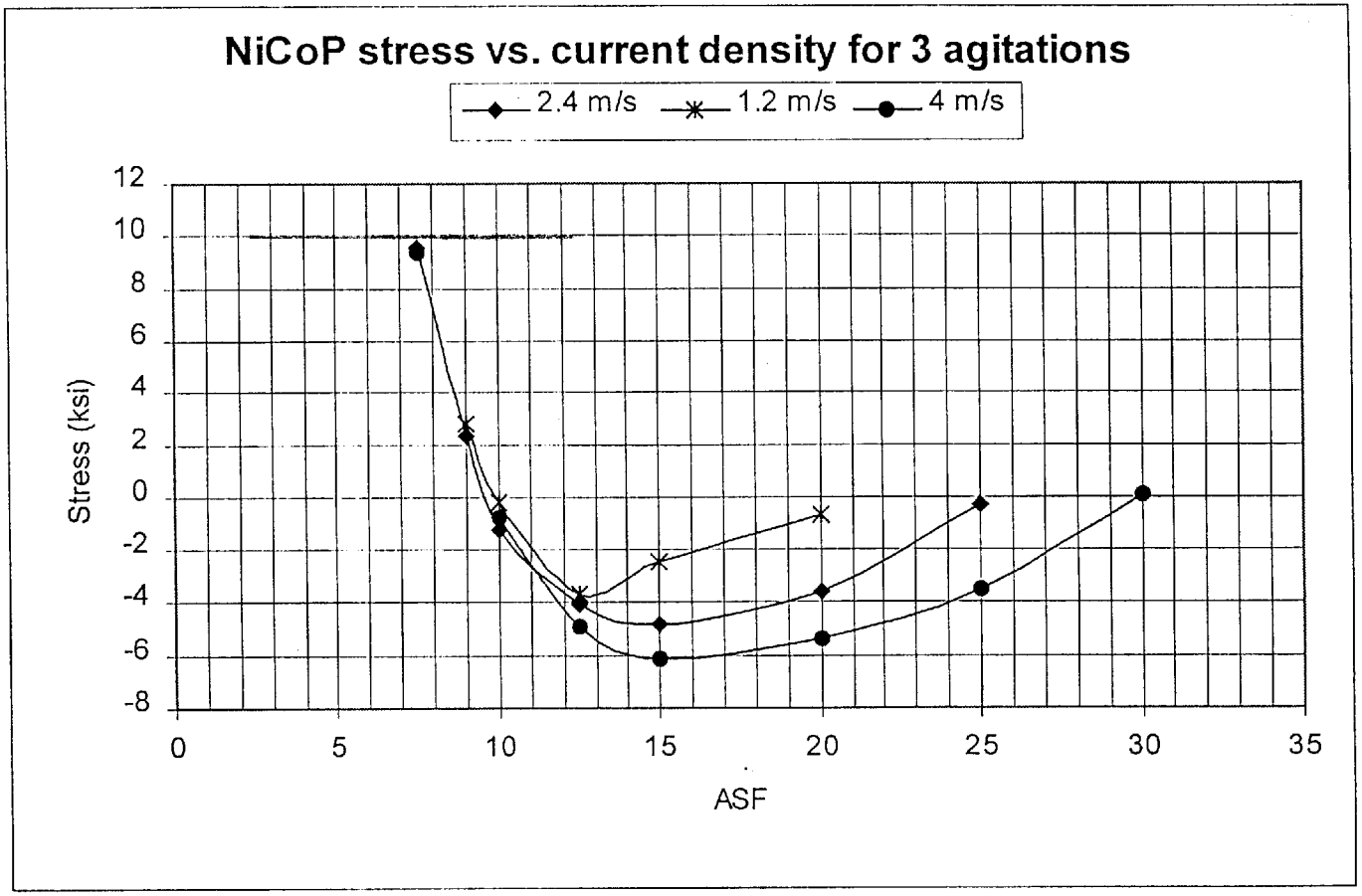

Figure 2 : Stress vs. agitation and current density.

NICKEL COBALT PHOSPHOROUS LOW STRESS ELECTROPLATING

GOVERNMENT LICENSE RIGHTS

The United States Government has a paid-up license in this invention and the right in limited circumstances to require the patent owner to license others on reasonable terms as provided for by the terms of Contract Number NCC8-65 awarded by NASA-Marshall Space Flight Center.

FIELD OF THE INVENTION

This invention generally relates to electroplating of metal alloys, and in particular to processes for electrodeposition of nickel and nickel cobalt phosphorous alloys.

BACKGROUND OF THE INVENTION

The deposition of nickel phosphorous alloys has generally been known in the art. The deposited nickel phosphorous alloys can be useful as corrosion and wear resistance coatings on many different substrates. In addition, they can also be used in decorative coatings and in the fabrication of certain optical components.

Nickel phosphorous alloys can be deposited by electroless or electrolytic processes. However, the electroless processes known in the art are generally limited to the deposition of rather thin nickel phosphorous coatings. This in part is due to the low plating rate, continuous chemical feed, frequent need to remove solution from the tank for maintenance, and high cost associated with these processes. The internal stress in the electroless deposited alloys cannot be precisely controlled in real-time during the plating process and the mechanical properties of the alloys are less than optimum for many operations. For example, electroless processes generally are not suitable for preparing thick deposits or freestanding forms. In addition, the electroless processes typically require a hazardously high plating temperature at or above 85° C. and are associated with the evaporation of the plating bath solution forming potentially hazardous vapors.

There has been significant effort in the art in developing and improving electrolytic nickel phosphorous plating processes. For example, U.S. Pat. Nos. 4,673,468 and 4,767,509 disclose that "sulfate" baths for nickel phosphorous electroplating have relatively poor cathode efficiency and, poor bath conductivity and that unwanted precipitates are easy to form in the bath. The patents disclose that improved alloy quality can be obtained by increasing the anode current density to at least 200 amperes per square foot. The patents propose an all-chloride bath prepared from $NiCl_2$ and $H_3PO_3$, $H_3PO_4$, $NiCO_3$, $Ni(H_2PO_3)_2$ and/or HCl. The plating is conducted at a cathode current density of at least 200 amperes per square foot, at a temperature of 78° C. or higher, and in an extremely acidic bath having an acid titer in the range of about 9–14 milliliters (9–14 mls of deci-normal sodium hydroxide are required to bring one milliliter of a bath solution to a pH of 4.2.). The plating efficiency is also low resulting in copious hydrogen evolution and high stress in the deposit.

U.S. Pat. No. 4,808,967 provides an electroplating bath consisting essentially of nickel carbonate, phosphoric acid, and phosphorous acid. Sulfate and chloride salts are excluded from the bath. The bath can be used to electroplate circuit board materials containing from 8 to 30 percent by weight of phosphorous. It is stated that because of the lack of chloride and sulfate salts, the plating bath results in circuit board material exhibiting increased stability and decreased porosity.

Despite the efforts in the art, the electrodeposition of nickel phosphorous alloys have generally found limited industrial applications due to the various drawbacks in the heretofore known electroplating processes. For example, plating is generally done at very high current densities, and the plating efficiency is very low. The processes normally require plating at a pH of less than 2.0, making the bath solution very corrosive to base metals. As a result, expensive precious metal anodes such as platinum and rhodium anodes have to be used. The processes typically require plating at high temperatures of above 75° C. to increase the cathode current efficiency and to control the internal stress in the deposited alloy. With the high temperature, low plating efficiency, corrosive solution and constant chemical additions required, there has been little incentive to use the prior art electrolytic processes. Accordingly, there remains need for developing improved processes for electroplating nickel phosphorous or nickel cobalt phosphorous alloys.

SUMMARY OF THE INVENTION

This invention provides electroplating bath formulations and processes for electrodepositing from the baths nickel phosphorous alloys or nickel cobalt phosphorous alloys that contain at least about 2% and up to 25% by atomic volume of phosphorous. The preferred electroplating bath for electroplating nickel phosphorous alloys has a composition including nickel sulfate, hypophosphorous acid or a salt thereof, boric acid or a salt thereof, a monodentate organic acid or a salt thereof, and a multidentate organic acid or a salt thereof. A surfactant such as Triton X-100 or sodium laurel (dodecal) sulfate is optionally included. For electroplating nickel cobalt phosphorous alloys, the bath contains, in addition, a cobalt source such as cobalt sulfate. The electroplating baths normally have a pH of from about 3.0 to 4.5.

The alloys of the present invention can be electrodeposited from the bath onto a substrate at a current density of less than about 35 $mA/cm^2$ and a temperature of from about 25° C. to about 70° C., preferably less than about 50° C. Anodes such as platinum or other precious metal anodes can be used in the electroplating. Preferably, one or more soluble anodes containing nickel and/or cobalt metal or alloys thereof can be used in electroplating using the electroplating bath of this invention.

In accordance with the electroplating process of this invention, the internal stress in the electrodeposited alloys can be conveniently controlled in real time to zero stress or near zero stress. When electroplating from a specific bath composition of this invention at a given temperature and a predefined pH, the internal stress in an electrodeposited alloy varies with the current density in the electroplating bath. The relationship between the internal stress and the current density, and, in particular, the current density at which the internal stress is zero, can be determined. By monitoring internal stress in the electrodeposited alloy, and adjusting the current density in response to the monitored internal stress, real time control of the internal stress to about zero can be achieved even at a low temperature of less than about 50° C.

The electroplating process of this invention may be operated for an extended period of time with little operator intervention required other than simple pH adjustment and occasional additions of phosphorous sources in the electroplating bath. This is in contrast to the constant chemical additions and frequent stripping of the process tanks and equipment required in prior art nickel phosphorous plating processes.

The electroplating process of this invention is normally conducted at a low temperature. As a result, lower energy cost is incurred, and loss of the electroplating bath composition due to evaporation is minimal. In addition, less volatile chemicals evaporate into the air thus alleviating health and safety concerns to a great extent.

The preferred high strength nickel alloys electrodeposited from the bath typically have at least about 8% by atomic volume of phosphorous and generally exhibit exceptional strength and microyield while having a lower density than pure nickel. In a preferred embodiment, the alloy of this invention contains from about 30% to 77% by atomic volume of nickel, from about 15% to 50% by atomic volume of cobalt, and from about 8% to 20% by atomic volume of phosphorus. Typically, the alloys of this invention do not reach 0.2% engineering yield and have a microyield of at least about 86 kg/mm$^2$ (125 ksi), an ultimate strength of at least about 175 kg/mm$^2$ (250 ksi), a density of less than about 8.0 grams/cc and hardness of RC 50 to 54. The alloys can be conveniently machined with hard tools such as high-speed steel, carbides, nitrides or diamond. They are substantially amorphous and can be polished with optical quality abrasives to form excellent quality optical components. Accordingly, the alloys are useful in many industrial applications. In particular, since the alloys have a lower density and high strength, lightweight X-ray mirrors having a large collecting area can be made from them for detecting galactic and extragalactic light sources. The thinner X-ray mirrors can be launched into space at lower cost per unit collection area due to the high microyield strength, preventing permanent deformation.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

BRIEF DESCRIPTION OF THE INVENTION

Figure 1:
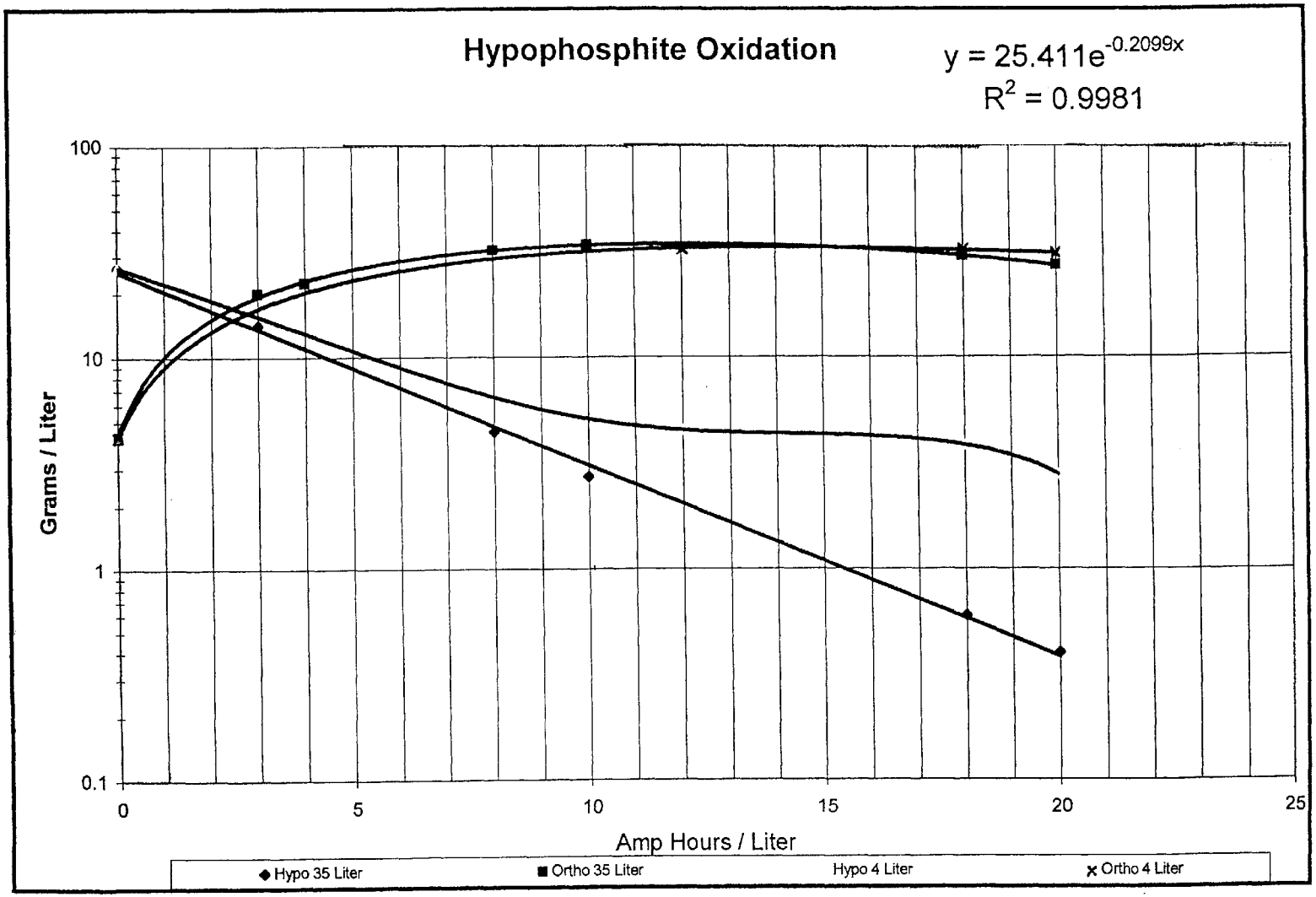
Figure 3:
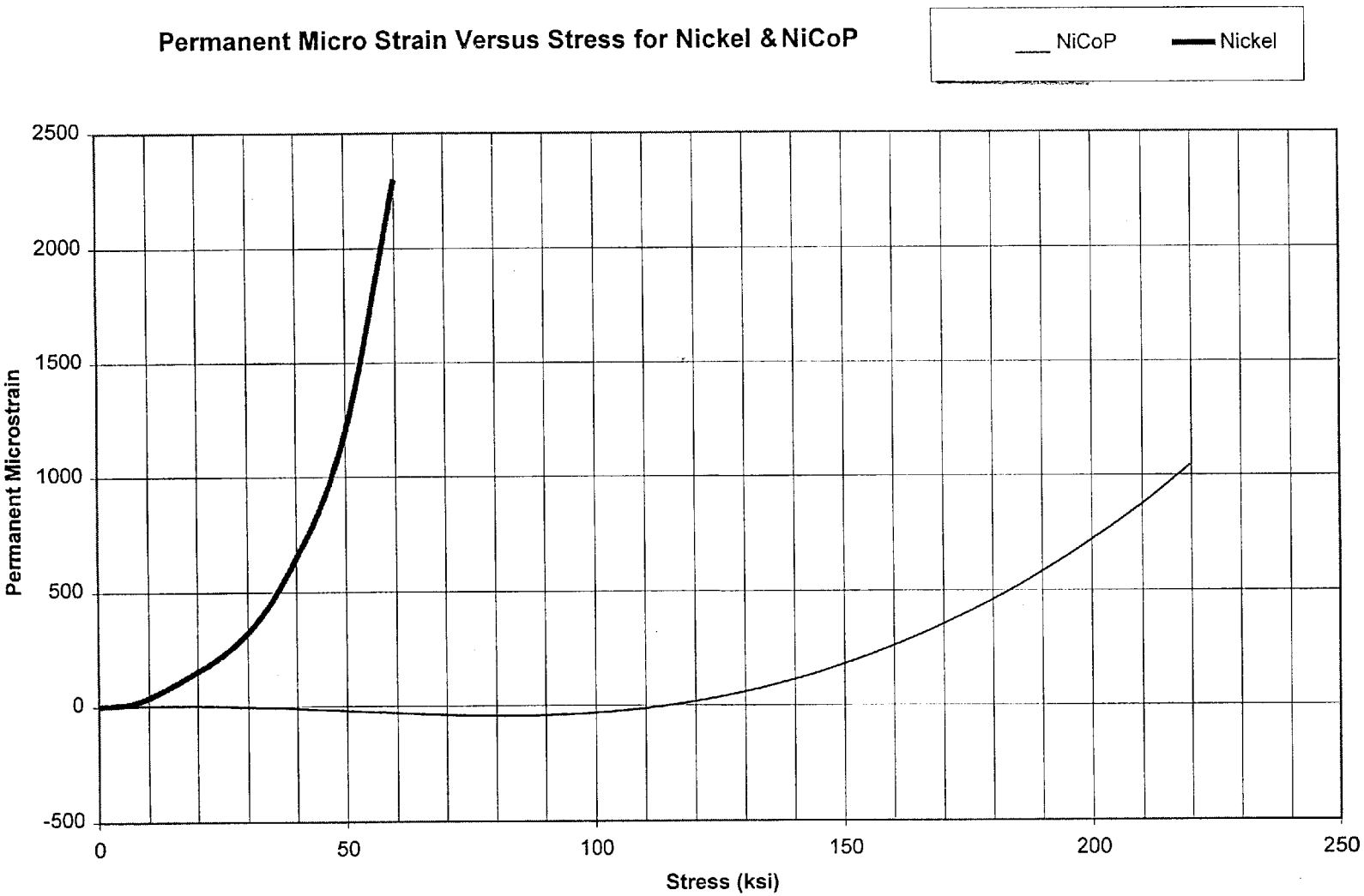

FIG. 1 illustrates the dynamic change of the concentration of hypophosphite during the electroplating process of this invention;

FIG. 2 demonstrates the relationship between current density, agitation and internal stress in an embodiment of the electroplating process of this invention;

FIG. 3 is a diagram comparing the permanent strain versus repetitive tensile loading of a nickel cobalt phosphorous alloy of this invention, to conventional plated pure nickel.

DETAILED DESCRIPTION OF THE INVENTION

The electroplating baths for electroplating nickel or nickel cobalt phosphorous alloys have a composition including a nickel source, hypophosphorous acid or a salt thereof as a phosphorous source, boric acid or a salt thereof, a monodentate organic chelating agent, and a multidentate chelating agent. For electroplating nickel cobalt phosphorous alloys, the bath contains in addition a cobalt source such as cobalt sulfate. Typically, the electroplating baths have a pH of from about 3.0 to about 4.5.

Normally nickel sulfate is used as the nickel source in the bath although other nickel compounds may also be used independently or in combination with nickel sulfate. Examples of useful nickel compounds include but are not limited to nickel hypophosphite, nickel oxide, nickel carbonate, nickel chloride or a combination thereof. Normally, nickel sulfate is preferred as it gives excellent results at nominal cost. Typically, the electroplating bath has a nickel sulfate concentration of from about 150 mM to about 800 mM, preferably from about 300 mM to about 400 mM.

Hypophosphorous acid and/or a salt thereof is included in the electroplating bath as a phosphorous source in an amount of from about 100 mM to about 400 mM, preferably from about 150 mM to 300 mM. Concentrations beyond the above ranges are also contemplated, although the process stability and plating results may be compromised somewhat. Typically, the salt is an alkaline earth metal salt such as sodium, potassium, or lithium salt. Alternatively, nickel hypophosphite or ammonium hypophosphite can also be used. Other suitable salts of hypophosphorous acid can also be included. Advantageously sodium hypophosphite is used as it not only gives rise to superior result but also is less expensive.

Boric acid or a salt thereof is normally included at a concentration of from about 0.25 M to about 1.5 M, preferably from about 0.5 M to about 1.0 M. The salt may also be an alkaline earth metal salt such as sodium, potassium, or lithium salt. Nickel salt and ammonium salt can also be used.

The organic chelating agents can be any suitable organic ligands capable of chelating nickel and/or cobalt atoms at oxidation states to form complexes. As will be apparent to a skilled artisan, such organic ligands can donate one or more pairs of electrons to the same cation (e.g., nickel or cobalt ion) to form chelating bonds. As used herein, the term "monodentate" denotes those organic chelating agents having one donor atom that can donate one pair of electrons to nickel or cobalt ion. Typically, unless otherwise specified, a carboxylic acid or an amino acid having one carboxyl group and no donor atom outside the carboxyl group is considered to be monodentate. As used herein, the term "multidentate" refers to organic chelating agents having two or more donor atoms, each of which can donate one pair of electrons to the same nickel or cobalt ion.

Typically, the organic chelating agents used in the present invention are organic acids (e.g., carboxylic acids and salts thereof), amines such as ethylenediamine, and amino acids. The electroplating baths of this invention contains at least one monodentate organic chelating agent and at least one multidentate organic chelating agent. Examples of suitable monodentate organic chelating agents include acetic acid, propionic acid, glycolic acid, formic acid, lactic acid, glycine and salts thereof. Alkaline earth metal salts and nickel salt are preferred. Examples of multidentate organic chelating agents include, but are not limited to, malonic acid, oxalic acid, succinic acid, citric acid, malic acid, maleic acid, tartaric acid, ethylenediamine, ethylenediamine tetraacetic acid (EDTA), amino acids, and the like. Salts of the multidentate acids can also be used. The preferred salts are alkaline earth metal salts, ammonium salts, nickel salts, and cobalt salts in the case of nickel cobalt phosphorous plating.

Typically, a monodentate organic chelating agent is included in the plating bath in an amount of from about 200 mM to about 600 mM, preferably from about 250 mM to about 500 mM. Normally, the monodentate agents are used at a higher concentration than the multidentate agents. The concentration of a multidentate organic chelating agent can be from about 10 mM to about 200 mM, preferably from about 30 mM to about 150 mM. It has been found that the combination of monodentate and multidentate organic chelating agents. significantly improves the characteristics of the electroplating process and the alloys deposited therefrom. While not wishing to be bound by any theory, it is believed that this is due to the shift in reduction potentials of the nickel and/or cobalt, which induces convergence of the metal deposition potential with the phosphorous.

In addition to the above components, the electroplating bath of this invention may optionally contain a surfactant, including Triton X-100, sodium laurel (dodecal) sulfate (SDS) and the like, at about 20 to about 500 parts per million (ppm) based on the total weight of the electroplating bath. It has been found that such surfactants, especially SDS can significantly reduce the tendency of pitting.

For electroplating nickel cobalt phosphorous alloys, the plating bath contains, in addition to the above described components, a cobalt source such as cobalt sulfate, typically at a concentration of from about 10 mM to about 80 mM, preferably from about 20 mM to about 50 mM.

The electroplating baths of this invention normally are maintained at a pH of 3.0 to about 4.5, preferably from about 3.8 to about 4.2. Although a pH value outside this range may be tolerable, the characteristics of the electroplating process and the plated alloy may be less satisfactory. The pH of the plating bath can be adjusted using any suitable basic or acidic agents. For example, since the freshly made plating bath normally is acidic and has a pH below the desired pH ranges, the pH can be increased by adding a base, such as sodium hydroxide. The pH of the plating bath should be maintained within the preferred range during the plating process. Normally the pH value of the bath increases somewhat as an alloy is electroplated from the plating bath using soluble anodes. The pH should be monitored and adjusted with appropriate acid(s) during the plating process. Examples of useful acids for adjusting pH include sulfuric acid, hypophosphorous acid, and ortho-phosphorous acid. Preferably, hypophosphorous acid is used to adjust the pH of the bath while maintaining the proper level of reducible phosphorous.

Normally, the various ingredients as discussed above are used within their solubility limits and are dissolved in an aqueous carrier, to form a solution substantially free of solid materials or precipitates. The solution is preferably filtered before use to remove any solid precipitates. A container tank is used to hold the bath solution during the plating process. Preferably, the plating bath is stirred or agitated with conventional devices.

The electroplating bath has one or more anodes immersed in the bath having a positive potential applied thereto. Insoluble and non-consumable anodes generally known in the art, including precious metal anodes of platinum and rhodium, or certain coated anodes such as, but not limited to, platinum coated titanium can all be used. Soluble or consumable anodes are preferred. Use of soluble anodes is possible in the present invention due to the relatively high pH of the electroplating bath. The less acidic bath does not cause substantial corrosion to the soluble anodes beyond that desired for metal replenishment while the current is applied. Suitable soluble anodes are those made of pure nickel or a nickel alloy that releases nickel ions upon the application of a positive potential on the anodes. When cobalt is desired in the electroplated alloy, one or more anodes made of pure cobalt or a cobalt alloy can be used in addition to the soluble nickel anode(s). Alternatively, one or more anodes made of a nickel cobalt alloy may be useful for releasing both nickel and cobalt ions into the plating bath when a positive potential is applied thereto. When a soluble anode is used, the anode need not be removed from the electroplating bath during idle periods. This is the result of higher pH and metal concentrations which bring into equilibrium the solution and anode corrosion potential kinetics.

A substrate onto which an alloy is to be electrodeposited is used as the cathode and is immersed in the bath with a negative potential applied thereto. While electroplating, an alloy coating is formed on the surface of the substrate. Thus, the cathode can be any mechanical parts or components that require an alloy coating, and, in particular, a substantially amorphous alloy coating. As will be apparent from the discussions below, the electrodeposited alloys of this invention can have a significantly greater thickness and microyield strength as compared to those made by prior art processes.

The electrodeposited alloy deposit of this invention can be separated from the substrate intact. The process of this invention can be used to form freestanding alloy objects in which the cathode is used not only as a substrate but also to define substantially the shape of the final freestanding objects. For example, in one embodiment, an aluminum mandrel is first coated with a layer of electroless or electrolytically deposited nickel phosphorous, then with an oxide layer, and then with a thin layer of gold by evaporation in a vacuum chamber. The resultant mandrel can be used as cathode for the electrodeposition of a nickel phosphorous or nickel cobalt phosphorous alloy according to this invention. The low adherence at the gold/oxide interface allows for the removal of the alloy shell from the mandrel by cooling the system, taking advantage of the differential thermal expansion of the mandrel and shell.

The electroplating process of this invention is normally conducted at a bath temperature of less than about 70° C. For plating low stress nickel phosphorous alloys in the absence of cobalt, a temperature of from about 55° C. to about 65° C. is preferred. When it is desirable to conduct the electroplating process with low stress at a relative low temperature of below about 50° C., cobalt is added. Advantageously in this case, the bath temperature is typically maintained at from about 35° C. to 45° C.

The electroplating process can be conducted at a wide range of applied current densities, preferably no greater than 40 $mA/cm^2$, more preferably no greater than about 35 $mA/cm^2$ to permit low stress plating. The optimum current density for low or zero stress varies with the composition, the pH, and the temperature of the electroplating bath. Some minor degree of experimentation may be required to determine the optimal current density for a particular plating bath under particular conditions, this being well within the capability of one skilled in the art once apprised of the present disclosure. In any event, it is advantageous to conduct the electroplating at a current density of from about 2 $mA/cm^2$ to about 30 $mA/cm^2$. The deposition rate can range from about 0.1 mil/hour to about 1.2 mil/hour. Higher plating rates are possible for thin deposits wherein some internal stress may be acceptable.

Another feature of the electroplating process of this invention is real-time stress control during electrodeposition. Internal stresses created during electrodeposition in the electrodeposited alloys can cause deformation in the workpiece and reduced microyield strength and tensile strength in the final products. Although stress reducers including saccharin are known in the art to be useful in reducing stress in some nickel plating processes, they degrade the electrodeposited nickel phosphorous or nickel cobalt phosphorous alloys in the processes of the present invention.

Several factors affect internal stress in the electrodeposited alloy, including bath composition, temperature, current density, and agitation. Typically, for a given plating bath composition under a fixed temperature and subjected to a chosen degree of agitation internal stress varies with the current density. Thus, in order to control internal stress, the electroplating process begins with a current density preselected based on prior experience such that the internal stress is zero or near zero. As the electroplating process continues, the internal stress is measured and the current density is adjusted in response to the measured stress by lowering or raising the current output of the power supply for the electroplating bath.

Preferably, testing of the electrodeposition is performed to determine the relationship between internal stress and current density under given conditions, and especially the current density at which internal stress reaches zero. A graph can be plotted, typically with stress as the Y axis and current density as the X axis. The stress-current density graph reflects the stress corresponding to each different current density value under the given conditions. Thus, in actual electroplating, the process can be initiated at a current density that gives rise to zero internal stress. During long term electroplating or precision electroforming operations, internal stress can be monitored. The current density can be adjusted in response to the measured internal stress so that the overall stress is reduced to near zero.

Methods and apparatuses for measuring stress during electrodeposition are generally known in the art, including those disclosed in, e.g., U.S. Pat. Nos. 4,986,130, 4,786,376, 4,648,944, and 4,647,365, all of which are incorporated herein by reference. For example, the electronic stress monitor disclosed in U.S. Pat. No. 4,986,130 is useful. Essentially, the monitor is a diaphragm that is fluid coupled to a pressure sensor in the format of a fluid amplifier. The arrangement permits very sensitive measurement of the force applied in a bending moment on the diaphragm due to the internal stress in the deposit which is applied to the diaphragm. The monitor allows real-time, in-tank, stress monitoring of the plating process while using either the ongoing process power supply or any suitable laboratory power supply including pulsed units. The monitor can also be linked to a processor such as a computer programmed according to the stress-current density graph for simple automatic real-time stress control. One or more methods of stress monitoring can be used in combination to assure the accuracy and repeatability of the measurements of the internal stresses. Many checks of material properties including stress can be made on plated rings of about 2.5 centimeter diameter and 0.25 mm thickness. The ring is separated from the substrate and cut or broken to allow relaxation of the shape. If the deposit is tensile the ring will open and likewise a compressive deposit will close in on the original shape. Calculation of the stress can be performed based on the change in the gap.

Unique to this plating process, zero stress can be achieved normally at two current density settings within the preferred current density range, of from about 2 $mA/cm^2$ to 40 $mA/cm^2$. Some minor degree of experimentation may be required to determine the optimal current density for achieving zero or near zero stress for a particular plating bath and under particular conditions, this being well within the capability of one skilled in the art once apprised of the present disclosure.

Normally, when electroplating nickel phosphorous in the absence of cobalt, it is preferred that the temperature of the electroplating bath is at a relatively higher temperature of from about 55° C. to 65° C. to better achieve zero or near zero internal stress in the electroplated nickel phosphorous alloy. A temperature of greater than 70° C. is undesired.

In a preferred embodiment, cobalt is included in the electroplating process for plating a nickel cobalt phosphorous alloy. It has been found that the presence of cobalt effectively reduces the stress and allows zero stress electrodeposition at a relatively lower temperature. When cobalt is present at a concentration within the above-described concentration range, the electroplating process of this invention can be carried out with zero stress or near zero stress at a temperature less than 45° C. with satisfactory electroplating results.

FIG. 1 demonstrates the change in the concentration of hypophosphite during the operation of a typical electroplating bath of this invention. As shown in FIG. 1, the hypophosphite, which is used for the supply of phosphorous in the alloys, in the plating bath of this invention initially is converted at an exponential rate to orthophosphite in addition to the deposited phosphorous in the alloy. During the course of this oxidation, there is very little change in electroplating efficiency or in the properties of the deposited alloy. However, after a certain amount of electroplating, of about 10 to about 15 amp-hours/liter, the concentration of orthophosphite becomes steady and remains unchanged while the concentration of hypophosphite continues to decrease, in the absence of replenishment, as the electroplating process is continued. The stable concentration is achieved initially in the preferred formulations eliminating the need to pre-electrolyze the solution to achieve optimum results.

As demonstrated in FIG. 1, after sufficient electrolysis, the diminished molar amount of hypophosphite while plating equals the molar amount of phosphorous deposited in the alloy. Thus, in electroplating a particular alloy, only an amount of hypophosphite that is stoichiometrically equivalent to the total deposited phosphorous is required to maintain the bath at a substantially constant state with respect to hypophosphite. For example, when a plated alloy contains 11% by atomic volume of phosphorous, this amount as phosphorous is preferably replaced using hypophosphorous acid or a salt thereof such as sodium hypophosphite. Thus, in accordance with this invention, with a plating bath operating at the proper range of orthophosphite to hypophosphite, hypophosphite may be added to the bath to replenish the hypophosphite that has been consumed. This occurs in the range of 10 to 15:1 orthophosphite to hypophosphite. Until this time no hypophosphite needs to be added to the solution.

This 1:1 phosphorous consumption ratio for the described electrolytic process is in sharp contrast to the conventional electroless nickel processes wherein the solution maintenance consumption of hypophosphite is typically at five times the equivalent of the deposited phosphorous. The high maintenance consumption in the prior art processes leads to an early saturation in orthophosphite at about 100 grams/liter and the requirement for dumping or rejuvenating the electroless bath.

In some instances where the bath contains lead due to the use of certain commercially purchased components (e.g., Enthone B from Enthone, West Haven, Conn.), an amount of pre-electroplating of about 1 to 2 amp-hours/liter of electrolysis or more may be required in a newly prepared bath. This allows removal of contaminants such as lead. Prior to the completion of the pre-electroplating, it may be required to operate at a higher temperature to achieve a low stress and stable alloys, or one may simply disregard the deposit obtained by plating a dummy panel. Some minor degree of experimentation may be required to determine the degree of electrolysis required before the bath reaches the optimum condition for electroplating, this being well within the capability of one skilled in the art once apprised of the disclosure.

In general, under the electroplating process conditions of this invention, the electroplating bath can be operated for a long period of time. For example, a small 35-liter solution nickel cobalt phosphorous bath prepared for testing was operated for more than 200 amp-hours/liter and remained in good condition. During this extended period, no precipitation was observed while plating. The solution had not been removed from the tank and the original filters and anodes had been in place for about five months with no sign of degradation of the process. Maintenance of the pH is required to avoid potential precipitation of cobalt. One of a series of 4 liter test solution nickel phosphorous bath without cobalt operated at 65° C. was producing sound deposits after 200 amp-hour/liter of operation with a nickel anode. In an optical mirror application a 2500-liter nickel cobalt phosphorous alloy bath has been in use for about one year and is performing well. It is believed that the operational life of the electroplating bath when used in the process of this invention can be close to indefinite with only minor maintenance such as adding hypophosphite and adjusting pH.

In accordance with the present invention, a nickel phosphorous alloy is provided. The preferred nickel phosphorous alloy has from about 11% to about 15% by atomic volume of phosphorous with the rest being nickel. This range provides for high strength, low stress and a density of less than about 8.0 grams/cc.

In accordance another aspect of this invention, a nickel cobalt phosphorous alloy is provided containing from about 30% to 77% by atomic volume of nickel, from about 15% to 50% by atomic volume of cobalt, and from about 8% to 20% by atomic volume of phosphorus. In a preferred embodiment, the nickel cobalt phosphorous alloy has about 30% of cobalt, about 11% of phosphorous and about 59% of nickel. This alloy range permits specific properties to be achieved by design.

Typically, the nickel phosphorous alloy and nickel cobalt phosphorous alloy of this invention can have a precision elastic limit (also known as microyield) of about 85 kg/mm$^2$ (125 ksi). An alloy shell electroformed according to this invention on a mandrel normally can sustain the removal from the mandrel and additional handling steps even with a diameter to thickness aspect ratio of more than 3000:1. The yield strength of the alloys of this invention are essentially the same as the ultimate strength since it is not possible to achieve 0.2% permanent deformation.

The ultimate strength is typically at least about 175 kg/mm$^2$(250 ksi), preferably at least about 195 kg/mm$^2$ (280 ksi) as measured at room temperature. In fact, the alloys have on occasion been loaded with as much as 300 ksi without permanent deformation as defined by the engineering yield of 0.2%. The microyield onset is at least about 50 kg/cm$^2$(70 ksi), more typically at least about 185 kg/$^2$. (125 ksi) and permanent yield does not typically exceed 0.02%. The alloys can have a hardness (RC) of about 50 to 54 Rockwell C. Yet, they can be conveniently machined with hard tools such as high speed steel, cubic boron nitride, tungsten carbide or diamond tools.

In accordance with the electroplating process of this invention, nickel phosphorous alloys and nickel cobalt phosphorous alloys of a variety of thickness can be formed. The desired thickness is determined by the end use of the alloy deposit. For example, for applications such as decorative coatings and corrosion protection coatings, a thickness of 0.025 mm to about 0.06 mm is typically electrodeposited. Unlike prior art processes, much thicker alloys can be electroplated from the present invention with satisfactory qualities. For example, the alloy deposit can have a thickness of at least about 0.15 mm. Alloys of up to 1 m$^2$ area and from 0.26 to 1.0 mm thick can be electroformed without difficulty. Sound deposits of about 7.5 mm (0.3 inch) have also been plated. Even so the deposit thickness was limited only by the time in the plating process and not poor quality.

Normally, the alloys of this invention have a density of lower than about 8.0 gm/cc. Typically, the density is at least about 10% lower than that of pure nickel. The alloys of this invention are substantially amorphous or at least microcrystalline as analyzed under electron microscope or x-ray diffraction assays.

In accordance with another aspect of this invention, an optical mirror is provided made of an alloy of this invention. The alloy is electrodeposited on a mandrel having a smooth surface of a shape that substantially conforms to the optical surface to be made. The electroplating according to this invention gives rise to an alloy that has an even thickness and conforms to the shape of the mandrel. After removal from a specifically shaped but perhaps unpolished mandrel, the alloy can be further polished and mounted to form an optical mirror. Since the alloys of this invention have a low density and a high strength, lightweight x-ray mirrors having a large collecting area can be made from them for detecting galactic and extragalactic light sources. The x-ray mirrors can be launched into space at a lower cost per unit area.

The invention is further illustrated by the following non-limiting examples.

EXAMPLE 1

An electroplating bath for depositing a nickel phosphorous alloy was prepared according to the formulation in Table I:

TABLE 1

| | |
|---|---|
| 17.5 grams/L | Nickel as sulfate |
| 10 grams/L | Sodium hypophosphite |
| 10 grams/L | Orthophosphorous acid |
| 30 grams/L | Glycolic acid |
| 10 grams/L | Citric acid |
| 40 grams/L | Boric acid |

The pH of the bath was initially adjusted to 3.1 with 10 N sodium hydroxide. The temperature of the bath was heated and maintained at 65° C. An "S" round nickel anode in a titanium basket from INCO of Toronto, Canada was used. The nickel phosphorous alloy was deposited onto an aluminum mandrel which has been coated with a layer of nickel phosphorous formed by electroless plating, an oxide layer adherent to the electroless nickel phosphorous layer, and a thin evaporated layer of gold over the oxide layer.

The electroplating was performed at a current density of 5 mA/cm$^2$. The internal stress was nearly free and was less than 0.35 kg/mm$^2$ (500 psi). After about 24 hours of electroplating, a nickel phosphorous alloy of 0.25 mm thick was formed containing 89% of nickel and 11% of phosphorous.

EXAMPLE 2

A nickel cobalt phosphorous alloy was plated using a bath having the same formulation as the bath in Example 1 except for the additional component of 1.5 grams/liter of cobalt (added in the form of cobalt sulfate). The anodes used were "S" round nickel anode material from INCO of Toronto, Canada and cobalt anode rounds also from INCO. The two anodes were arranged such that ⅔ of the current passes through the nickel anode and ⅓ passes through the cobalt anode. The electroplating was conducted at a current density of about 10 mA/cm$^2$ and at a temperature of 45° C. for about 24 hours. The substrate is a mandrel same as that used in Example 1.

An alloy deposit with a thickness of 0.25 mm was electroformed. The alloy shell was removed from the mandrel by cooling the assembly to about −10° C.

The alloy has 59% of nickel, 30% of cobalt, and 11% of phosphorous. The density of similar samples as tested by Mettler Microbalance gravimetrics was 7.8 gm/cc. The strength as tested by MTI, and Instron Tensile testers was 153 kg/mm$^2$ (220 ksi). The hardness as tested by Rockwell C was 52 RC without heat treatment.

EXAMPLE 3

An initial 35-liter electroplating bath for depositing a nickel phosphorous alloy was prepared according to the formulation in Table II:

TABLE II

| | |
|---|---|
| 17.5 grams/L | Nickel as sulfate |
| 10 grams/L | Sodium hypophosphite |
| 135 mL/L | Enthone "B" |
| 10 grams/L | Citric acid |
| 40 grams/L | Boric acid |

Enthone "B" was commercially available from Enthone, West Haven, Conn. The pH was adjusted to 4.0 with sodium hydroxide and the bath temperature was heated and maintained at between 65° C. and 70° C.

Zero stress was achieved at 5 mA/cm$^2$ and 14 mA/cm$^2$ respectively. The alloy obtained after plating at about 5 mA/cm$^2$ for about 24 hours had 89% by atomic volume of nickel, and 11% of phosphorous. The microyield as tested by the modified ASTM E-8 method was greater than 49 kg/mm$^2$ (70 ksi). The density as tested by gravimetrics was 7.8g/cc. The strength as tested by calibrated load cell was 188 kg/mm$^2$ (270 ksi). The hardness as tested by Rockwell Tester was 50 RC.

EXAMPLE 4

An initial 35-liter electroplating bath for depositing a nickel cobalt phosphorous alloy was prepared according to the formulation in Table III:

TABLE III

| | |
|---|---|
| 17.5 grams/L | Nickel as sulfate |
| 10 grams/L | Sodium hypophosphite |
| 135 mL/L | Enthone "B" |
| 10 grams/L | Citric acid |
| 40 grams/L | Boric acid |
| 10 grams/L | $CoSO_4.7H_2O$ |

The pH of the bath was initially adjusted to 4.0. Testing electroplating was performed by varying the current density from 5.0 mA/cm$^2$ to 35 mA/cm$^2$ with and without agitation. Agitation was achieved by the use of a variable speed stirrer with the flow directed to the stress monitor. The internal stress was measured using the Dawn Research SG-100 and IMD-100 electronic stress monitor in all cases, as described in U.S. Pat. No. 4,986,130 assigned to Engelhaupt et al. The addition of controlled agitation permitted studies of the process stress sensitivity to solution transport phenomena. This allowed for a complete study of the overall performance of the process.

FIG. 2 is a diagram illustrating the relationship between stress in the electroplated nickel cobalt phosphorous alloy and the current density. As FIG. 2 indicates, when plating within the current density range of 5 to 35 mA/cm2 using the electroplating bath as described at a fixed temperature and a preset agitation speed, the stress varied with the current density. Initially, at the low end of the current density range, stress was high. As the current density was increased, the internal stress in the electrodeposited alloy gradually decreased, crossed zero, and continued to decrease reaching a minimum. As the current density was further increased, the stress gradually increased to zero again. For example, when the agitation speed was at 2.4 m/s, the stress in the alloy was zero at about 9.5 mA/cm$^2$ and about 25 mA/cm$^2$.

EXAMPLE 5

A 2500-liter bath that has the same composition as that in Example 4 and had previously been electrolyzed for about 25 amp-hour/liter was used to electroplate a nickel cobalt phosphorous alloy. The bath showed no sign of degradation. The anodes used were "S" round nickel anode material from INCO of Toronto, Canada and cobalt anode rounds also from INCO. The two anodes were arranged such that ⅔ of the current passes through the nickel anode and ⅓ passes through the cobalt anode. The nickel phosphorous alloy was deposited onto an aluminum mandrel which had been coated with a layer of nickel phosphorous formed by electroless plating, an oxide layer adherent to the electroless nickel phosphorous layer, and a thin evaporated layer of gold over the oxide layer.

The electroplating was performed initially at a current density of 5 mA/cm$^2$ with moderate agitation of 2.4 meters/second to achieve an internal stress of zero. During the plating, the internal stress was monitored as described above and the current density was adjusted in response to the internal stress such that zero stress was obtained substantially throughout the entire electroforming process.

With this process about 0.8 grams/amp-hour of deposit was attained. As an example of the maintenance, the operating bath with an alloy being deposited was left unattended for periods of up to 24 hours with only minor water additions used throughout the entire plating run. No pH adjustment or chemical addition was made during the electroplating of an entire alloy component.

An alloy component of an area of approximately 1 square meter with a thickness of 0.25 mm was electroformed. The alloy shell was removed from the mandrel by cooling the assembly to about −10° C. The alloy had 59% of nickel, 30% of cobalt, and 11% of phosphorous, all by atomic volume. The microyield as tested by the method of ASTM E-8 was about 120 ksi. The sample density as tested by gravimetrics was 7.9 grams/cc. The strength as tested by calibrated load cell was about 250 ksi. The hardness as tested by Rockwell hardness tester was Rockwell C 54.

FIG. 3 illustrates the permanent strain of the alloy as compared to that in a pure nickel obtained from deposition in a commercial nickel sulfamate solution.

As is apparent from the diagram, the nickel cobalt phosphorous alloy exhibited essentially no ductility up to 84 kg/mm$^2$ (120 ksi) of applied stress while the regular nickel deposit extended severely and was in excess of 0.2% yield at about 61 kg/mm$^2$ (88 ksi).

As is apparent from the above discussions, the process of this invention is highly efficient, requires little maintenance, and is far less troublesome and hazardous than the current electroless nickel phosphorous processes. The process can be continued without frequent pauses in the process to clean equipment or reconstitute the degradation products as is required for electroless nickel plating. This permits deposition of thick, controlled low stress electroformed shapes. In addition, the hypophosphite consumption is reduced by a factor of four or five. Less expensive soluble anodes can be used reducing the need for the more expensive nickel and cobalt salts in solution. The heating requirement is minimized, and very little evaporation is associated with the process. As a result, fume extraction is minimized, reducing the amount of conditioned shop air required (HVAC). Additional cost may be required for the use of cobalt in some of the lowest temperature and low stress operations. But this is offset by the lower maintenance costs and minimal waste disposal issues and the very fact that controlled low stress is possible. Therefore, the present invention provides a method of producing nickel phosphorous and nickel cobalt phosphorous alloy deposits with exceptional qualities from a superior process. Although the foregoing invention has been described in some detail by way of illustration and example for purposes of clarity of understanding, it will be obvious that certain changes and modifications may be practiced within the scope of the appended claims.

What is claimed is:

1. An electroplating bath for electrodepositing a nickel alloy which contains from about 2 % up to about 25% by atomic volume of phosphorous, comprising:

nickel sulfate;

hypophosphorous acid or a salt thereof;

boric acid or a salt thereof;

a monodentate organic acid or a salt thereof; and a multidentate organic acid or a salt thereof.

2. The electroplating bath of claim 1, further comprising cobalt sulfate.

3. The electroplating bath of claim 2, wherein the monodentate organic acid is glycolic acid.

4. The electroplating bath of claim 2, further comprising a surfactant.

5. The electroplating bath of claim 2, wherein the electroplating bath has from about 150 mM to about 300 mM of sodium hypophosphite.

6. The electroplating bath of claim 2, wherein the cobalt sulfate is at a concentration of from about 20 mM to about 50 mM.

7. The electroplating bath of claim 2, further comprising from about 20 to 500 ppm of sodium laurel (dodecal) sulfate based on the total weight of bath.

8. The electroplating bath of claim 1, wherein said bath has a pH of about 3.0 to about 4.5.

9. The electroplating bath of claim 1, wherein said monodentate organic acid is selected from the group consisting of acetic acid, propionic acid, glycolic acid, formic acid, lactic acid, glycine and salts thereof.

10. The electroplating bath of claim 9, wherein the monodentate organic acid is at a concentration of from about 200 mM to about 600 mM.

11. The electroplating bath of claim 1, wherein said multidentate organic acid is selected from the group consisting of malonic acid, succinic acid, citric acid, tartaric acid, oxalic acid, malic acid, malic acid, ethylene diamine tetraacetic acid, amino acids and salts thereof.

12. The electroplating bath of claim 11, wherein said multidentate organic acid is at a concentration of from about 30 mM to about 150 mM.

13. The electroplating bath of claim 11, wherein said multidentate organic acid is citric acid.

14. An electroplating bath for electrodepositing a nickel alloy which contains at least about 2% up to 25% by atomic volume of phosphorous, comprising:

from about 300 to about 400 mM of nickel sulfate;

from about 150 mM to about 300 mM of hypophosphorous acid or a salt thereof;

from about 0.25 M to about 1.5 M of boric acid or a salt thereof;

from about 0.25 M to about 0.50 M of glycolic acid or a salt thereof; and from about 30 mM to about 150 mM of citric acid or a salt thereof, said bath having a pH of from about 3.0 to about 4.5

15. The electroplating bath of claim 14, further comprising from about 20 mM to about 50 mM of $CoSO_4$.

16. An electroplating bath for electrodepositing a nickel alloy which contains phosphorous in an amount of at least about 2% to 25% by atomic volume, said bath comprising:

from about 300 to 400 mM nickel sulfate;

from about 150 to 300 mM hypophosphorous acid or a salt thereof;

boric acid or a salt thereof;

a monodentate organic acid or a salt thereof; and a multidentate organic acid or a salt thereof.

17. A process for electroplating a substantially amorphous nickel alloy containing from about 2% up to about 25% by atomic volume of phosphorous onto a substrate comprising:

providing an electroplating bath containing nickel sulfate;

hypophosphorous acid or a salt thereof;

boric acid or a salt thereof;

a monodentate organic acid or a salt thereof; and a multidentate organic acid or a salt thereof;

said bath having a pH of from about 3.0 to about 4.5; and electrodepositing said nickel alloy from the bath onto the substrate.

18. The process of claim 17, wherein said electroplating bath further comprises cobalt sulfate.

19. The process of claim 18, wherein said monodentate organic acid is selected from the group consisting of acetic acid, propioic acid, glycolic acid, formic acid, glycine, lactic acid and salts thereof.

20. The process of claim 18, wherein said multidentate organic acid is selected from the group consisting of malonic acid, succinic acid, citric acid, taulanc acid, oxalic acid, maleic acid, malic acid, ethylene diamine tetraacetic acid, amino acids and salts thereof.

21. The process of claim 17, wherein said monodentate organic acid is selected from the group consisting of acetic acid, propionic acid, glycolic acid, formic acid, lactic acid, glycine and salts thereof.

22. The process of claim 17, wherein said multidentate organic acid is selected from the group consisting of malonic acid, succinic acid, citric acid, tartaric acid, oxalic acid, maleic acid, malic acid, ethylene diamine tetraacetic acid, amino acids and salts thereof.

23. A process for electroplating a substantially amorphous nickel alloy containing at least about 2% up to 25% by atomic volume of phosphorous onto a substrate comprising:

providing an electroplating bath containing from about 300 to about 400 mM of nickel sulfate;

from about 150 mM to about 300 mM of hypophosphorous acid or a salt from about 0.25 M to about 1.5 M of boric acid or a salt thereof;

from about 0.25 M to about 0.50 M of glycolic acid or a salt thereof; and from about 30 mM to about 150 mM of citric acid or a salt thereof, said bath having a pH of from about 3.0 to about 4.5; and electrodepositing said nickel alloy from the bath onto the substrate.

24. The process of claim 23, wherein said electrodepositing step is conducted at a current density of no greater than about 35 mA/cm$^2$.

25. The process of claim 23, wherein a soluble anode comprising nickel is used.

26. The process of claim 23, wherein the electroplating step is conducted at a temperature of no greater than about 70° C.

27. A process for electroplating a substantially amorphous nickel cobalt phosphorous alloy containing from about 2% to about 25% by atomic volume of phosphorous onto a substrate comprising:

providing an electroplating bath containing from about 300 to about 400 mM of nickel sulfate;

from about 20 mM to about 50 mM of cobalt sulfate;

from about 150 mM to about 300 mM of hypophosphorous acid or a salt thereof;

from about 0.25 M to about 1.5 M of boric acid or a salt thereof;

from about 0.25 M to about 0.50 M of glycolic acid or a salt thereof; and from about 30 mM to about 150 mM of citric acid or a salt thereof, said bath having a pH of from about 3.0 to about 4.5; and electrodepositing said nickel cobalt phosphorous alloy from the bath onto the substrate.

28. The process of claim 27, wherein the electroplating step is conducted at temperature of less than about 50° C.

29. The process of claim 27, further comprising controlling internal stress in the electrodeposited alloy in real time.

30. The process of claim 29, wherein the step of controlling internal stress comprises:

monitoring an internal stress in the electrodeposited alloy; and adjusting the current density in response to the monitored internal stress.

31. The process of claim 29, wherein the internal stress of the electrodeposited alloy is controlled to less than about 1000 pounds per square inch.

32. The process of claim 29, wherein the internal stress of the electrodeposited alloy is controlled to less than about 100 pounds per square inch.

33. The process of claim 27, wherein a soluble anode comprising nickel or cobalt or both is utilized.

34. The process of claim 27, wherein the electroplating is conducted at a current density of no greater than about 35 mA/cm$^2$.

35. A process for electroplating a substantially amorphous nickel cobalt phosphorous alloy containing from about 2% to about 25% by atomic volume of phosphorous onto a substrate comprising:

providing an electroplating bath containing from about 300 to about 400 mM of nickel sulfate;

from about 20 mM to about 50 mM of cobalt sulfate;

from about 150 mM to about 300 mM of hypophosphorous acid or a salt thereof;

from about 0.25 M to about 1.5 M of boric acid or a salt thereof;

from about 0.25 M to about 0.50 M of glycolic acid or a salt thereof; and from about 30 mM to about 150 mM of citric acid or a salt thereof, said bath having a pH of from about 3.0 to about 4.5 and a temperature of no greater than about 50° C.; and electrodepositing said nickel cobalt phosphorous alloy from the bath onto the substrate at a current density of no greater than about 35 mA/cm$^2$.

36. A process for electroplating onto a substrate a substantially amorphous nickel alloy containing phosphorous in an amount of at least about 2% to 25% by atomic volume, comprising the steps of:

providing an electroplating bath containing from about 300 to 400 mM nickel sulfate, from about 150 to 300 mM hypophosphorous acid or a salt thereof, boric acid or a salt thereof, a monodentate organic acid or a salt thereof, and a multidentate organic acid or a salt thereof; and electrodepositing said nickel alloy from the bath onto the substrate.

* * * * *

UNITED STATES PATENT AND TRADEMARK OFFICE

CERTIFICATE OF CORRECTION

PATENT NO. : 6,406,611 B1
DATED : June 18, 2002
INVENTOR(S) : Engelhaupt et al.

It is certified that error appears in the above-identified patent and that said Letters Patent is hereby corrected as shown below:

Title page,
Item [56], References Cited, OTHER PUBLICATIONS, "No." should read -- Nov. --; and "Bindish" should read -- Bindlish --.

Column 9,
Line 60, "kg/cm$^2$" should read -- kg/mm$^2$ --;
Line 60, "kg/$^2$" should read -- kg/mm$^2$ --.

Column 13,
Line 66, "malic", first occurrence, should read -- maleic --.

Column 14,
Line 53, "taulanc" should read -- tartaric --.

Column 15,
Line 42, after "at" insert -- a --.

Signed and Sealed this

Nineteenth Day of November, 2002

*Attest:*

*Attesting Officer*

JAMES E. ROGAN
*Director of the United States Patent and Trademark Office*